United States Patent [19]

Mattos

[11] 3,933,087

[45] Jan. 20, 1976

[54] BALER WIRE CARTON AND SYSTEM

[76] Inventor: Manuel A. Mattos, 1424 Eucalyptus, Patterson, Calif. 95363

[22] Filed: Nov. 25, 1974

[21] Appl. No.: 526,451

Related U.S. Application Data

[63] Continuation of Ser. No. 316,111, Dec. 18, 1972, abandoned.

[52] U.S. Cl. ..... 100/1; 100/DIG. 12; 206/394; 206/409; 229/51 DB; 242/129

[51] Int. Cl.[2] ..... B65B 13/18

[58] Field of Search ..... 100/8, 1, DIG. 12; 242/129, 159, 170, 171; 229/51 DB; 206/391, 394, 409, 498, 395, 408, 396

[56] References Cited

UNITED STATES PATENTS

| | | | |
|---|---|---|---|
| 1,952,056 | 3/1934 | Cook | 242/171 X |
| 2,127,578 | 8/1938 | Wyman | 206/498 X |
| 2,527,401 | 10/1950 | Daoust | 206/408 |
| 2,579,131 | 12/1951 | Tinsley | 206/409 |
| 2,674,372 | 4/1954 | Schweich | 206/396 |
| 2,888,132 | 5/1959 | Guyer | 229/51 DB |
| 3,017,021 | 1/1962 | Ruiz | 206/395 X |
| 3,028,117 | 4/1962 | Shepley | 242/129 |
| 3,193,179 | 7/1965 | Bogren | 242/129 |
| 3,215,332 | 11/1965 | Bess | 229/51 BD |
| 3,241,790 | 3/1966 | Hudgins | 242/129 |

*Primary Examiner*—Billy J. Wilhite
*Attorney, Agent, or Firm*—Julian Caplan

[57] ABSTRACT

Standard baler machines use a plurality of wires to tie the bales. Each wire is fed from a coil which is transported from the wire works in a paperboard carton which is rectangular in shape and appropriately scored on either of its two broad sides to enable the centers of the sides to be removed in circular cutouts. The lead end of the coil of wire is drawn out of one cutout and threaded through appropriate guides to the tie mechanism. The tail end of the coil is usually drawn out of the opposite cut-out and spliced to the lead end of a second coil in a second carton. The two cartons are usually installed back to back in a rack on the baler with a space between the adjacent broad sides. In accordance with the present invention, each carton is scored or otherwise weakened from the top of one cut-out, over the top of the carton to the top of the opposite cut-out. Thus, when the coil has been fed out of the first carton, the top is conveniently laid open, the first carton removed from the wire, the second carton moved on the rack to the place of the former first carton, another carton placed in the rack behind the second, and the tail end of the second coil spliced to the lead end of the third.

3 Claims, 4 Drawing Figures

BALER WIRE CARTON AND SYSTEM

This is a continuation of application Ser. No. 316,111, filed Dec. 18, 1972, now abandoned.

This application contains information included in Disclosure Document No. 008395 of January 8, 1972.

This invention relates to a new and improved baler wire carton and system.

Conventional baling machines consume successive coils of wire when the machine is used over a prolonged period of time. A quantity of wire is formed at the wire works in a coil which is enclosed in a carton for transportation and dispensing purposes. When the wire is to be used, circular cut-outs are provided on the front and back broad surfaces of the rectangular carton; and when the material which has previously occupied these cut-outs is removed, access to the interior of the carton is provided. There are two ends of the coil exposed, usually identified by one or more tags. The leading end of the wire is pulled out through one of the cut-outs and the trailing end is pulled out through the opposite cut-out. At the beginning of installation of the baling wire, the leading end is pulled through various guides (pulleys, etc.) including wire tieing mechanism of the baler chamber. This is a time consuming operation, and it is desirable that the number of times that the wire must be installed through the guides be reduced. Accordingly, it is common practice to splice the trailing end of the first coil of wire on to the leading end of the next coil of wire to be used. Hence, unless there is a breakage of the wire, there is no necessity for threading the wire through the guides and wire tieing mechanism more than once. Accordingly, two cartons are stored in a rack back to back in an appropriate place on the machine, the wire being drawn out of the first carton and the trailing end of the first carton being spliced to the leading end of the second carton. When the contents of the first carton are exhausted, the second carton is moved on the rack to the position formerly occupied by the first carton, another carton is installed behind the second carton, and the wires in the second and third cartons spliced together. However, this still leaves the first carton encircling the wire between the rack and the guides which direct the wire into the tieing mechanism. The present invention provides a carton and a system which facilitate removal of the exhausted first carton from any contact with the wire.

In essence, the present invention provides a convenient means for breaking open the top of the exhausted carton so that the carton may be pulled away from the wire and discarded. Heretofor, it has been necessary to break open the carton either by considerable manual effort (by reason of the strong construction inherently required in the carton) or by using various tools such as saws and knives. The present invention eliminates these prior methods of opening the exhausted carton.

Accordingly, it is a principal purpose of the present invention to enable empty cartons to be removed from position encircling wire with very little effort and no tools.

A further feature of the invention is the fact that use of the carton and system speeds operation of the baler, reduces the physical labor required and also reduces danger of injury to personnel while improving the efficiency of the baling operation.

A further feature of the present invention is the fact that very little change is required in the construction, or fabrication, of the carton and the production of the cartons is not slowed or otherwise adversely affected.

Other objects of the present invention will become apparent upon reading the following specification and referring to the accompanying drawings in which similar characters or reference represent corresponding parts in each of the several views.

Figure 1:
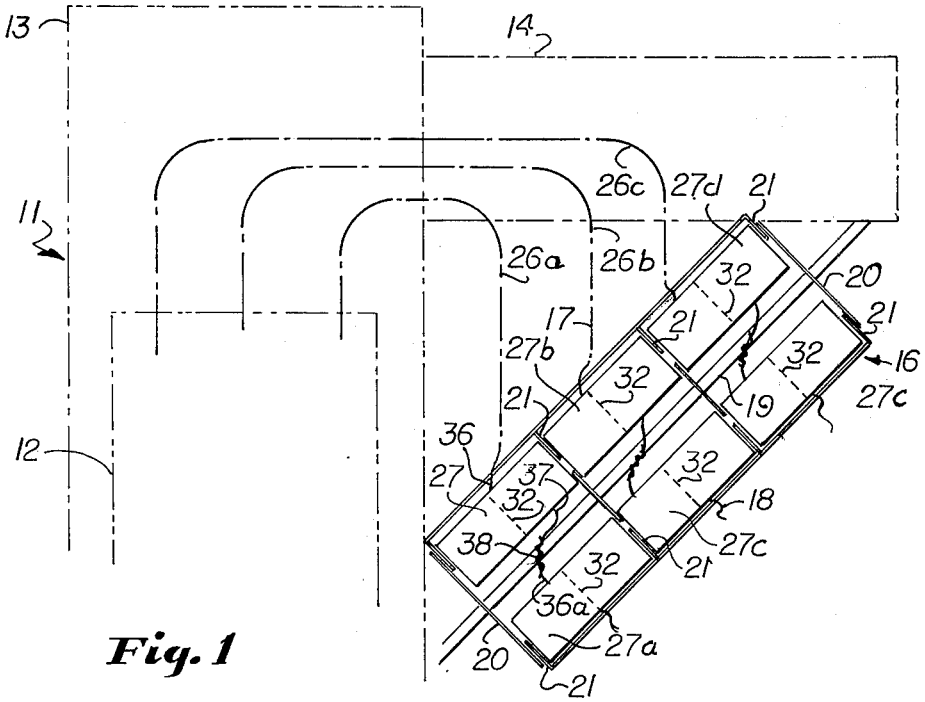
FIG. 1 is a schematic top plan view showing a portion of a baler machine with which the present invention may be used having a rack for storing six wire cartons, two for each of the three wires of the baler.

In FIG. 1 there is shown schematically one type of commercially available hay baler, it being understood that the present invention may be used with a variety of balers. In the baler 11 shown in FIG. 1, three wires 26*a*, *b*, *c* are used, it being understood that in some baling machines two wires or more than three wires may be employed. The present invention is readily adaptable to other baling machine constructions as will readily occur to one skilled in this art. For purpose of convenience in illustration and description, it is assumed that the baler 11 has a baling chamber 12 adjacent its discharge end and forwardly of chamber 12 is a front chamber 13 into which cross-feed 14 discharges. In the angle between chamber 12 and cross-feed 14 it is customary to install a rack 16 for the baling wire. Again, these racks differ in construction depending upon the manufacturer's design and the rack 16 here illustrated is merely typical. As shown, there is an inner longitudinal side 17 and an outer longitudinal side 18 with a partition and support 19 there-between. Ends 20 are disposed at either end of the rack. Extending inward from the sides 17, 18 are brackets 21 which space the cartons apart and prevent their unintentional dislodgement.

Figure 3:
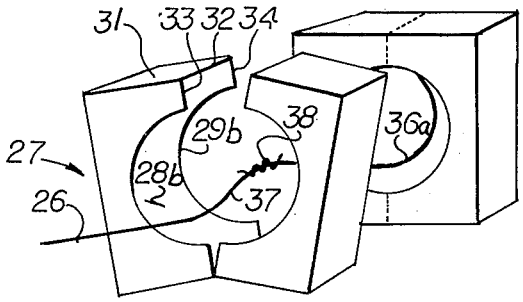
FIG. 3 is a perspective view showing an empty carton broken open to permit removal of wire which is shown attached to the coil in the next carton.
Figure 2:
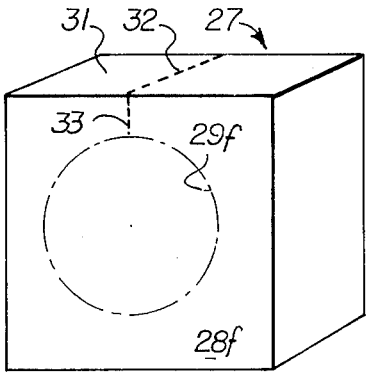
FIG. 2 is an enlarged perspective view of one of the cartons.

Disposed in the rack 16 are six cartons 27–27*e*, inclusive, there being two cartons for each wire 26*a*, 26*b*, 26*c* which are directed by guides (not shown but well understood in this art) around to the front of the baling chamber 12 and into appropriate wire tieing mechanism (also not shown). Directing attention to FIG. 2, the carton 27 as received from the factory is rectangular and has broad front and back faces 28F, 28B. Each said face has a circular cut-out 29F, 29B, respectively, which is either left open during transportation from the factory or is opened in the field by removing circular cut-outs. Removal is facilitated by means of score lines which outline the circular cut-outs so that it is merely necessary to wrap the center of the cut-outs with the hand to cause the opening of the holes. An important feature of the novelty of the present invention is the fact that across the top 31 of carton 27 is a score line 32 and on the front 28F there is a score line 33 which extends down to the top of the cut-out 29F. Similarly, there is a vertical score line 34F from the score line 32 to the top of the cut-out 29*b* on the back 28*b*. As is shown in FIG. 3, because of the score lines 32, 33, 34, it is quite easy to break open the carton 27 at the top.

Ordinarily, the wire is formed in a coil inside the carton 27. The leading end of the first carton 27 (see FIG. 1) is pulled out of cut-out 29F and fed into the wire guides. The trailing end 37 of the coil within the first carton 27 extends out through the back cut-out 29B. A second carton 27*a* is installed in rack 16 behind carton 27. Its leading end 36*a* is attached to the trailing end 37 of the first carton 27 with a splice 38.

In use, the trailing end 36 is pulled out of the carton 27 and the operation continues until the carton 27 is exhausted. By reason of the existence of splice 38, when this occurs, the baler begins to consume wire from the second carton 27*a*. After this has continued for a period of time, at some convenient stopping point, the operator stops the baler. He fractures the carton 27 along the score lines 33, 32, 34 and breaks open the box as shown in FIG. 3. This permits the box 27 to be removed from the wire and discarded. The second carton 27*a* is then removed from the position which it is shown occupying in FIG. 1 to the position formerly occupied by carton 27. A third carton (not shown) is then installed behind the newly located carton 27*a* and spliced thereto. This permits the cartons to be used consecutively without ever needing to rethread the wire unless there should be a breakage. Although not separately described herein, it will be understood that the other two of the three baling wires are handled in the same manner.

Figure 4:
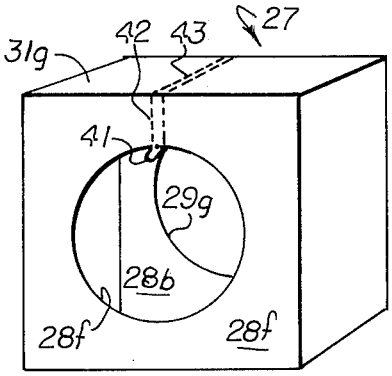
FIG. 4 is a view similar to FIG. 2 of a modified construction.

FIG. 4 shows a modification. A tear strip having a finger grip 41 is applied at the top of cut-out 29F of front face 28F of modified carton 27*g*. Such tear strips are well known in the carton art, usually consisting of a reinforced fabric which is glued to the underside of a strip in the carton which is to be opened. By pulling tab 41, the carton may be severed up along line 42 on front 28F, then along line 43 across top 31*g* and thence down to cut-out 29G along a line (not shown) corresponding to line 42. In other respects, this carton is the same as that of FIG. 2 and corresponding reference numerals are used.

What is claimed is:

1. A system for the purpose described comprising a rack mounted on a baling machine, said rack having brackets for positioning first and second rectangular cartons side by side with a gap between said cartons, each said carton being formed of paperboard and initially having a closed front and back each formed with a central circular first score line adapted to be manually severed without the use of tools to form a cut out and four sides interconnecting said front and back, one said side comprising a top when said carton is installed in said rack, a coil of wire in each said carton having a leading and a trailing end, said leading end of said coil in said first carton extending out through the back cutout in said first carton, said leading end of said coil in said second carton extending out through the front cutout of said second carton and being spliced to said trailing end of said coil in said first carton, said cartons being insertable in and removable from said brackets, the top of each said carton initially being completely closed, each said top being formed with a second score line across said top and down said front and back to intersect said cutouts of said front and back, said carton being easily manually severable along said second score line without use of tools to lay open said top and permit removal of said carton from encirclement of wire.

2. A carton for use on a rack mounted on a baling machine, said rack having brackets for positioning two of said cartons side by side with a gap between said cartons said carton being insertable in and removable from said brackets, said carton being rectangular and being formed of paperboard and initially having a closed front and back, said carton being formed with central circular front and back score lines adapted to be manually severed without the use of tools to form front and back cut outs and four sides interconnecting said front and back, one said side comprising a top when said carton is installed in said rack, a coil of wire in said carton having a leading and a trailing end, said leading end of said coil being adapted to extend out through said front cut-out, said trailing end of said coil being adapted to extend out through said back cutout, the top of said carton initially being completely closed, said top being formed with a second score line across said top and down said front and back to intersect said front and back cutouts, said carton being easily manually severable along said second score line without use of tools to lay open said top and permit removal of said carton from encirclement of said wire.

3. A carton according to claim 2 in which said carton has a tear strip of reinforced material underlying said second score line and a pull tab on one end of said tear strip whereby on pulling said tab and pulling said strip off said carton said carton is laid open.

* * * * *